US005827101A

United States Patent [19]

Cathey et al.

[11] Patent Number: 5,827,101

[45] Date of Patent: Oct. 27, 1998

[54] ANODE FOR FLAT PANEL DISPLAY

[75] Inventors: David A. Cathey, Boise; Charles M. Watkins, Meridian; James J. Hofmann, Boise, all of Id.

[73] Assignee: Micron Display Technology, Inc., Boise, Id.

[21] Appl. No.: 40,129

[22] Filed: Mar. 17, 1998

Related U.S. Application Data

[62] Division of Ser. No. 781,830, Jan. 10, 1997.

[51] Int. Cl.[6] ..... H01J 29/18; H01J 29/32

[52] U.S. Cl. ..... 445/24; 445/58

[58] Field of Search ..... 445/24, 52, 58

[56] References Cited

U.S. PATENT DOCUMENTS

| | | | |
|---|---|---|---|
| 5,497,925 | 3/1996 | Bell et al. | 313/497 |
| 5,508,584 | 4/1996 | Tsai et al. | 313/497 |
| 5,520,563 | 5/1996 | Wallace et al. | 445/24 |
| 5,545,946 | 8/1996 | Wiemann et al. | 313/496 |
| 5,606,225 | 2/1997 | Levine et al. | 313/497 |

OTHER PUBLICATIONS

Hase, Takashi et al., *Advances in Electronics and Electron Physics*, vol. 79, pp. 352–357, Ed. Peter W. Hawkes, Academic Press, Inc. Jan. 1990.

*Primary Examiner*—Kenneth J. Ramsey
*Attorney, Agent, or Firm*—Hale and Dorr LLP

[57] ABSTRACT

An anode of a flat panel display besides having a glass substrate, a patterned black grille on the substrate, a conductive layer covering the grille and the substrate, and a phosphor layer covering, also has one or more additional transparent layers that reduce the reflectance of the flat panel display from 14% down to 1%–4%. These additional layers are placed between the black matrix grille and the substrate, and between the conductive layer and phosphor layer. The two additional layers are selected and designed to reduce the reflectance that occurs at these respective interfaces.

24 Claims, 1 Drawing Sheet

ANODE FOR FLAT PANEL DISPLAY

CROSS REFERENCE TO RELATED APPLICATION

This application is a divisional of application Ser. No. 08/781,830, filed Jan. 10, 1997, now pending, which is incorporated by reference in its entirety.

STATEMENT OF GOVERNMENT RIGHTS

This invention was made with Government support under Contract No. DABT63-93-C-0025 awarded by the Advanced Research Projects Agency (ARPA). The Government may have certain rights in this invention.

FIELD OF THE INVENTION

This invention relates to an anode of a flat panel display and to methods for improving an image seen by a viewer of a flat panel display.

BACKGROUND OF THE INVENTION

Flat panel displays include a cathode and an anode, separated with spacers and enclosed in a vacuum. The anode typically includes an outer glass layer and an inner phosphor layer. Emitters in the cathode emit electrons, which strike the phosphor layer on the anode and emit light.

During viewing, ambient light from outside the anode tends to reflect off the glass layer of the anode and the various inner layers of the anode at the intersections between layers. These reflectances reduce contrast and reduce the picture quality as seen by a viewer. The total reflectance of such systems can be as much as 14%, which in some circumstances is unacceptable.

SUMMARY OF THE INVENTION

It is an object of the present invention to improve the image seen by a viewer of a flat panel display by reducing the reflectance of ambient light.

In one aspect of the present invention, the anode of a flat panel display besides having a glass substrate, a patterned black grille on the substrate, a conductive layer covering the grille and the substrate, and a phosphor layer covering, also has one or more additional transparent layers that reduce the reflectance of the flat panel display from 14% down to 1%–4%. These additional layers are placed between the black matrix grille and the substrate, and between the conductive layer and phosphor layer. The two additional layers are selected and designed to reduce the reflectance that occurs at these respective interfaces.

The present invention thus provides anodes for a flat panel display and methods for producing anodes with reduced reflectance and improved contrast. Other features and advantages will become apparent from the following detailed description, drawings, and claims.

DETAILED DESCRIPTION OF PREFERRED EMBODIMENTS

Figure 1:
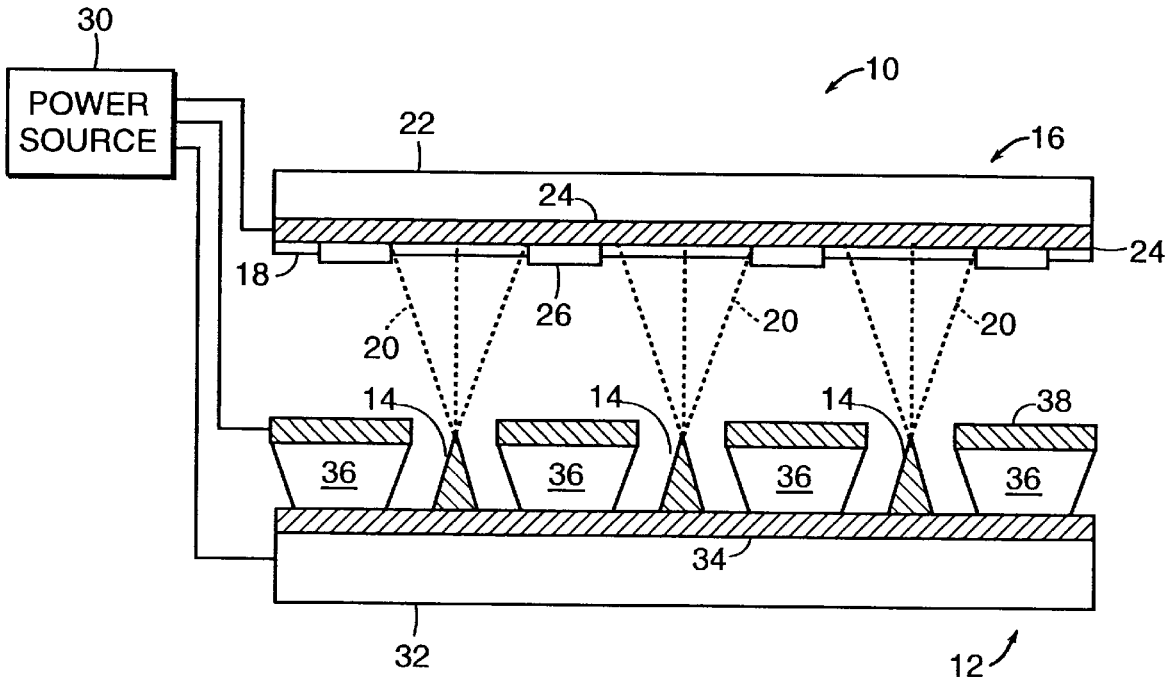
FIG. 1 (PRIOR ART)
FIG. 1 is a cross-sectional view of a known field emission display with a known cathode and anode.

A conventional structure of a known field emission display (FED) is illustrated in FIG. 1. FED 10 has a cathode 12 with an array of conical thin film emitters 14, and an anode 16 with phosphor layer 18 in the open regions defined by patterned black grille 26. When activated, emitters 14 emit electrons 20 to excite phosphor layer 18 to provide a lighted image. Anode 16 and cathode 12 have vacuum gap between them and may be separated with spacers (not shown).

Anode 16 has a glass substrate 22 covered with a transparent conductive layer 24, preferably indium tin oxide (ITO). Over ITO layer 24, patterned black matrix 26, such as cobalt oxide, is deposited as particulates to form a grille. As stated, this grille, defines an array of regions in which phosphor layer 18 is disposed. Alternatively, the black matrix can be patterned on substrate 22. In this embodiment, transparent conductive layer 24 is placed over grille 26 and substrate, and the phosphor layer 18 is disposed on conductive layer.

Cathode 12 has a substrate 32 and a number of conductive layers 34 arranged as strips over the substrate. Conical emitters 14 are formed on conductive layers 34. Dielectric layer 36 surrounds emitters 14. A conductive extraction grid 38 covers dielectric layer 36.

A power source 30 is coupled to conductive layer 24 in anode 16, to extraction grid 38, and to conductive layers 34 in cathode 12. The power source controls the electric field and hence the current and the brightness of the display, and also provides row-column addressing by selectively activating extraction grid 38 and conductive layers 34. When an emitter 14 is activated, electrons are emitted and strike phosphor layer 18.

Figure 2:
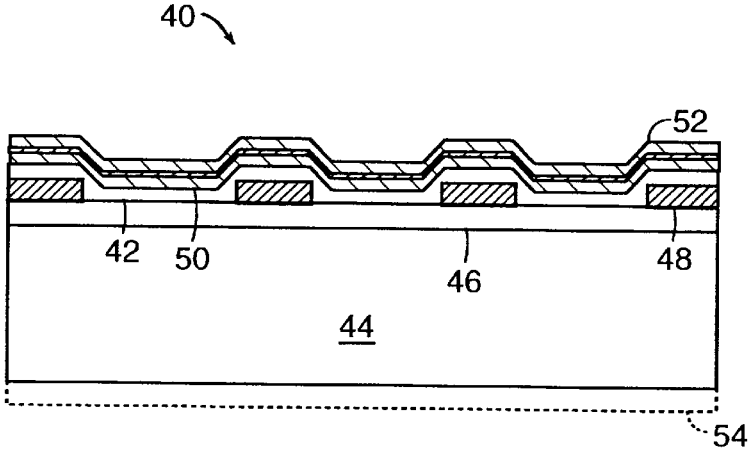
FIG. 2 is a cross-sectional view of an anode for a field emission display according to the present invention.

Referring to FIG. 2, anode 40 of the present invention is shown. This anode may be used with the cathode 12, shown in FIG. 1, or other conventional cathode structure. Anode 40 is constructed to reduce significantly the amount of reflectance of the FED screen. To accomplish this, anode 40 includes one or more additional layers at specific interfaces.

In FIG. 2, glass substrate 44, preferably of soda-lime glass, has a first reflectance reducing layer, in the form of transparent intermediate layer 46, deposited on it. Patterned black grille 48 is deposited on intermediate layer 46 and defines the areas through which the phosphor layer, when excited, will be visible. Preferably, the grille 46 is made from cobalt oxide (CoOx). Transparent conductive layer 42 is deposited over intermediate layer 46 and the patterned black grille 48. As shown, the transparent conductive layer is contoured to the pattern of the black grille. The transparent conductive layer may be ITO layer.

A second reflectance reducing layer, in the form of index matching glass (IMG) layer 50, is disposed on the ITO layer. The IMG layer seeks to transition the refractive index of conductive layer 42 to the refractive index of phosphor layer 52 in such a manner to reduce reflectance at the interface. The IMG layer is followed by phosphor layer 52, preferably of yttria ($Y_2O_3$).

The two additional layers are placed at two interfaces to effect controlled changes in the refractive indexes at these interfaces. The present invention will now be described in greater detail with regard to the two layer that are added.

In order to achieve a total reflectance that is substantially lower than the 14% that has been conventionally experienced, intermediate layer 46 and IMG layer 50 are used. When both of these layers are used, the total reflectance may be reduced to 1%–4%.

The first source of reflectance is at the interface between substrate 22 and patterned black grille 26. This high reflection is caused by the substrate having a refractive index (RI) of 1.51 and the black grille having an RI of 2.9. This is reduced by positioning intermediate layer 46 between the substrate and grille. A desired material for the intermediate layer will be a transparent material that has a refractive index (RI) determined by Expression 1:

$$RI=\sqrt{n_1 \cdot n_2} \quad (1)$$

where, $n_1$=The refractive index of substrate 44.

$n_2$=The refractive index of black grille 48.

The RI determined by Expression 1 will be between the RIs of the grille and substrate.

Once the material for intermediate layer 46 is determined, it is then necessary to determine a preferred physical thickness of the layer. The following will describe the determination of the physical thickness of intermediate layer 46.

The desired optical thickness of intermediate layer 46 is to be equivalent to ¼ λ of the center frequency of the visible spectrum, which is nominally 5200 Å. Given this optical thickness, the physical thickness of intermediate layer 46 is determined by Expression 2:

$$\text{Physical Thickness} = \frac{\left(\frac{\text{Optical Thickness}}{4}\right)}{RI\ \text{Intermediate Layer}} \quad (2)$$

A preferable material for intermediate layer 46 is silicon nitride ($Si_3N_4$) which has a refractive index of 2.1. If silicon nitride is the selected material, its thickness according to Expression (2) will be approximately 619 Å. This determination of thickness is based on an optical thickness of 5200 Å and the refractive index of silicon nitride being 2.1. If a silicon nitride layer that is 619 Å thick is placed between the grille and substrate, the reflectance should be reduced below 5% and, preferably, down to approximately 4%.

ITO 42 covers patterned black grille 48 and intermediate layer 46. Normally, the ITO layer is then covered with the phosphor layer. There is considerable reflectance that occurs at this interface which preferably is eliminated.

To reduce the reflectance between ITO layer 42 and phosphor layer 52, transparent IMG layer 50 is disposed at the interface. The IMG layer serves the purpose of filling the vacuum spaces that exist at this interface and cause reflectance. Preferably, the IMG layer is formed from a low melting point, lead-based glass, such as Corning 1416.

The IMG layer is formed by depositing a layer of glass particles on the ITO layer and then depositing a layer of phosphor material on the IMG layer. The entire structure is then fired at around 525° C. for approximately 20 minutes. This will cause the IMG to flow and eliminate the vacuum spaces between the ITO and phosphor layers. After the IMG layer has been positioned between the ITO and phosphor layers, the reflectance of the FED is further reduced to a range of 1%–4%.

The reflectance can be even further reduced if a separate layer 54 is placed on substrate 44 on the surface opposite the one on which intermediate layer 46 is disposed. This is conventional and this layer may be made from magnesium fluoride (MgF) or silicon dioxide ($SiO_2$).

The terms and expressions which are used herein are used as terms of expression and not of limitation. There is no intention in the use of such terms and expressions of excluding the equivalents of the features shown and described, or portions thereof, it being recognized that various modifications are possible in the scope of the present in the scope of the present invention.

We claim:

1. A method of making an anode for a field emission display, the method comprising:

disposing a transparent reflectance reducing intermediate layer on a transparent substrate;

disposing a grille on the intermediate layer with the grille defining a pattern of open regions on the intermediate layer;

disposing a conductive layer over the grille and intermediate layer; and disposing a phosphor layer on the conductive layer.

2. The method of claim 1, wherein the substrate is formed from soda-lime glass.

3. The method of claim 1, wherein the refractive index for the intermediate layer is determined by the Expression:

$$RI=\sqrt{n_1 \cdot n_2} \quad (1)$$

where, $n_1$=The refractive index of substrate;

$n_2$=The refractive index of grille.

4. The method of claim 1, wherein a thickness of the intermediate layer is determined by the Expression:

$$\text{Physical Thickness} = \frac{\left(\frac{\text{Optical Thickness}}{4}\right)}{RI\ \text{Intermediate Layer}} \quad (2)$$

where,

Optical thickness=¼ λ of a center frequency of a visible spectrum.

5. The method of claim 1, wherein the reflectance reducing intermediate layer is formed of silicon nitride.

6. A method of making an anode for a field emission display, the method comprising:

disposing a transparent reflectance reducing intermediate layer on a transparent substrate;

disposing a grille on the intermediate layer with the grille defining a pattern of open regions on the intermediate layer;

disposing a conductive layer over the grille and intermediate layer;

disposing a transparent reflectance reducing glass layer on the conductive layer; and disposing a phosphor layer on the conductive layer.

7. The method of claim 6, wherein the substrate is formed from soda-lime glass.

8. The method of claim 6, wherein the refractive index for the intermediate layer is determined by the Expression:

$$RI=\sqrt{n_1 \cdot n_2} \quad (1)$$

where, $n_1$=The refractive index of substrate;

$n_2$=The refractive index of grille.

9. The method of claim 6, wherein a thickness of the intermediate layer is determined by the Expression:

$$\text{Physical Thickness} = \frac{\left(\frac{\text{Optical Thickness}}{4}\right)}{RI\ \text{Intermediate Layer}} \quad (2)$$

where,

Optical thickness=¼ λ of a center frequency of a visible spectrum.

10. The method of claim 6, wherein the reflectance reducing intermediate layer is formed of silicon nitride.

11. The method of claim 6, wherein the reflectance reducing glass includes a lead-based glass.

12. The method of claim 6, wherein the reflectance reducing glass has a melting point less than a melting point of the conductive layer.

13. The method of claim 6, wherein the reflectance reducing glass has a melting point at or below 525° C.

14. The method of claim 6, wherein the reflectance reducing glass layer is formed between the conductive layer and phosphor layer by heating the anode to a temperature of 525° C.

15. The method of claim 14, wherein the reflectance reducing glass layer is formed between the conductive layer and phosphor layer by heating the anode to 525° C. for 20 minutes.

16. The method of claim 6, wherein the anode is further formed by disposing a third reflectance reducing layer on the substrate opposite a surface on which the intermediate layer is disposed.

17. The method of claim 16, wherein the third reflectance reducing layer is formed for magnesium floride.

18. The method of claim 16, wherein the third reflectance reducing layer is formed for silicon dioxide.

19. A method of making a field emission display, the method comprising:

disposing a grille defining a pattern of open regions over a substrate;

disposing a conductive layer over the grille;

forming a reflectance reducing glass layer over the conductive layer; and disposing a phosphor layer over the reflectance reducing glass layer.

20. The method of claim 19 wherein the reflectance reducing glass layer is formed from an index matching glass.

21. The method of claim 20 wherein the index matching glass is a lead-based glass.

22. The method of claim 21 wherein the lead-based glass is Corning 1416.

23. The method of claim 19 wherein the forming includes depositing a layer of glass particles on the conductive layer, and heating the glass particles to a sufficient temperature to cause them to melt and flow to form a layer.

24. The method of claim 19 wherein the depositing is performed before disposing a phosphor layer, and wherein the heating is performed after disposing a phosphor layer.

* * * * *

UNITED STATES PATENT AND TRADEMARK OFFICE

CERTIFICATE OF CORRECTION

PATENT NO : 5,827,101

DATED : October 27, 1998

INVENTOR(S) : Cathey et al.

It is certified that error appears in the above-identified patent and that said Letters Patent is hereby corrected as shown below:

In the title "ANODE FOR FLAT PANEL DISPLAY" should be changed to

-- FLAT PANEL DISPLAY ANODE THAT REDUCES THE REFLECTANCE OF AMBIENT LIGHT--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*